US006328133B1

(12) United States Patent
Kim

(10) Patent No.: US 6,328,133 B1
(45) Date of Patent: Dec. 11, 2001

(54) ELEVATOR DOOR WITH IMPROVED CLUTCH DEVICE

(75) Inventor: Jae Bum Kim, Kimhae (KR)

(73) Assignee: LG Otis Elevator Company, Seoul (KR)

( * ) Notice: Subject to any disclaimer, the term of this patent is extended or adjusted under 35 U.S.C. 154(b) by 0 days.

(21) Appl. No.: 09/459,983

(22) Filed: Dec. 14, 1999

(30) Foreign Application Priority Data

Dec. 15, 1998 (KR) ..... 98-55142

(51) Int. Cl.[7] ..... B66B 13/12; B66B 13/06

(52) U.S. Cl. ..... 187/319; 187/315; 187/330; 49/120

(58) Field of Search ..... 187/315, 318, 187/319, 330, 334; 49/116, 120, 118

(56) References Cited

U.S. PATENT DOCUMENTS

| | | | | |
|---|---|---|---|---|
| 1,911,818 | * | 5/1933 | Dunn | 187/319 |
| 2,019,456 | * | 10/1935 | Liebenberg | 187/319 |
| 3,065,826 | * | 11/1962 | Tucker, Jr. | 187/319 |
| 3,605,952 | * | 9/1971 | Lusti | 187/319 |
| 4,108,283 | * | 8/1978 | Mangel | 187/319 |
| 4,313,525 | | 2/1982 | McDonald . | |
| 4,926,974 | | 5/1990 | Morris et al. . | |
| 4,926,975 | | 5/1990 | Morris . | |
| 4,947,964 | * | 8/1990 | Husmann | 187/319 |
| 5,246,089 | * | 9/1993 | Husmann et al. | 187/319 |
| 5,690,188 | * | 11/1997 | Takakusaki et al. | 187/319 |
| 6,173,815 | * | 1/2001 | Mittermayr | 187/330 |

* cited by examiner

*Primary Examiner*—Christopher P. Ellis
*Assistant Examiner*—Thuy V. Tran
(74) *Attorney, Agent, or Firm*—Birch, Stewart, Kolasch & Birch, LLP

(57) ABSTRACT

Disclosed is an elevator door with an improved clutch device suitable for increasing clutch speed and decreasing clutch distance of a car door and a hatch door.

The elevator door with an improved clutch device comprises a hatch door having a pair of clutch rollers; a car door having a pair of clutch plates; a door motor for giving force to move the car door; a reduction pulley for reducing rotating speed of the door motor; a plurality of links for converting rotation of the reduction pulley to angular movement; a cam link having one end rotatably connected to one of the links, the cam link including a curved portion having various curvatures formed at the other end thereof; and a rotating link positioned between a pair of the clutch plates, the rotating link being rotatably connected to one of the clutch plates and in contact with the other of the clutch plates, the rotating link contacting with the curved portion of the cam link at its mediate portion, wherein angular movement of the cam link pushes the rotating link along the curved portion, which brings a pair of the clutch plates into contact with a pair of the clutch rollers respectively.

6 Claims, 12 Drawing Sheets

ELEVATOR DOOR WITH IMPROVED CLUTCH DEVICE

BACKGROUND OF THE INVENTION

1. Technical field

The present invention relates to an elevator door with an improved clutch device, and more particularly to a clutch system of an elevator door suitable for increasing clutch speed and decreasing clutch distance of a car door and a hatch door.

2. Description of the Prior Art

As the buildings are higher, there is need to provide an elevator, which may carry passengers to a destined floor faster. Faster movement of the elevator requires increasing vertical speed of the elevator as well as shortening time to open or close an elevator door.

Among those, the present invention deals with a technique of reducing time to open or close elevator doors with ensuring stable operation of the elevator doors.

The elevator door generally includes a car door installed to an elevator car and a hatch door installed to entrance of the elevator car in each floor. The car door may open with use of a driving unit mounted on the elevator car, while the hatch door moves along with the car door with use of a clutch system. In order to move the hatch door along with the car door, the clutch system performs a series of clutch operation, which will be explained in detail below.

Opening speed of the car door until completing the clutch operation of the car door and the hatch door (hereinafter, referred to "clutch speed") is important to door opening time. As the clutch speed is slower, time to open or close the elevator door increases, which makes it inefficient to carry passengers fast. Therefore, increase of the clutch speed of the car door and the hatch door helps to reduce the time to open or close the doors.

FIG. 1 and FIG. 2 are horizontal section view and vertical section view respectively showing schematic configuration of a conventional elevator. As shown in the figures, the elevator car 2 carries passengers with moving vertically in hoist way 1 by a separate driving unit. The car door 10 is installed at entrance of the elevator car 2 to open and close laterally. The hatch door 20 is positioned at each floor of a building, which the elevator serves, in order to allow passengers to enter the elevator car 2. The elevator door is a common name for designating both the car door 10 and the hatch door 20.

Unexplained reference 3 is for a counter weight.

FIG. 3 is a front view showing the elevator door according to the prior art, viewed at a car door side. Referring to the figure, a door motor 4 is mounted on the elevator car 2 for providing power to open or close the car door 10. At one side of the door motor 4, first and second reduction pulleys 5*a*, 5*b* are sequentially installed to reduce rotating speed of the door motor 4. The second reducing pulley 5*b* is combined with one end of a moving link 6 such that the moving link 6 may move in linkage with rotation of the second reduction pulley 5*b*. The other end of the moving link 6 is rotatably combined with one end of a main link 7, which is also rotatably combined with the elevator car 2. The other end of the main link 7 is rotatably combined with a cam link 13, which is positioned at a left door panel 10*a*. Viewed from the figure, a pair of clutch plates 11, 12 are installed at the left door panel 10*a*, a fixed clutch plate 11 of which the cam link 13 is rotatably combined with. A car frame 31 is mounted upon the elevator car 2 for supporting the elevator car 2. The main link 7 is fixed to the car frame 31 with a rotating joint 7*a* at its mediate portion to possibly rotate on center of the rotating joint 7*a*. A connecting link 8 is combined with an upper mediate portion of the main link 7. The other end of the connecting link 8 is rotatably connected to a certain position of a sub-link 9 at a right door panel 10*b*. One end of the sub-link 9 is rotatably fixed to the car frame 31 with a rotating joint 9*a*, while the other end is also rotatably combined with one end of a cam link 16. Viewed from the figure, a pair of clutch plates 14, 15 is installed to the right door panel 10*b*, a fixed clutch plate 14 of which the cam link 16 is rotatably combined with.

A pair of clutch plates 11, 12 or 14, 15 at the left or right door panel 10*a* or 10*b* includes the fixed clutch plate 11 or 14 and a movable clutch plate 12 or 15. The fixed clutch plate 11 or 14 is fixed to each door panel 10*a*, 10*b*, and the cam link 13 or 16 is rotatably combined with the fixed clutch plate 11, 14 as described above. The movable clutch plate 12, 15 is combined with the fixed clutch plate 11, 14 with a hinge 17*a* or 17*b*, which is well shown in FIG. 5 and FIG. 7.

Referring to FIG. 4 and FIG. 5, a pair of clutch rollers 21, 22 or 23, 24 is installed to each door panel 20*a*, 20*b* of the hatch door 20. The clutch rollers 21, 22 or 23, 24 include a fixed clutch roller 21 or 23 and a rotating clutch roller 22 or 24. The pair of clutch plates 11, 12 or 14, 15 are installed to have certain clearance therebetween, such that the clutch rollers 21, 22 or 23, 24 may pass through the clearance when the elevator car is moving. However, when the elevator car 2 arrives at a destined floor, the clutch rollers 21, 22 or 23, 24 are interposed between and becomes contacted with the pair of clutch plates 11, 12 or 14, 15 for the purpose of opening or closing the hatch door 20 along with the car door 10.

FIG. 6 and FIG. 7 are front and horizontal section views respectively showing the clutch system of the conventional elevator door. Referring to the figures, one end of the cam link 13 or 16 is rotatably combined with the main or sub-link 7 or 9 with a rotating joint J, while a roller 13*a* or 16*a* is mounted to the other end to freely rotate. A rugged cam 12*a* or 15*a* is formed on a side of the movable clutch plate 12 or 15 such that the roller 13*a*, 16*a* of the cam link 13, 16 may roll in contact with the rugged cam 12*a*, 15*a*. On the rugged cam 12*a*, 15*a*, a plurality of curved portions are formed in succession such that angular displacement of the movable clutch plate 12, 15 may be determined according to the height of the curved portions.

The fixed clutch plate 11, 14 and the movable clutch plate 12, 15 of the car door 10 and the fixed clutch roller 21, 23 and the rotating clutch roller 22, 24 of the hatch door 20 are installed to the left and right door panels 10*a*, 10*b* and 20*a*, 20*b* in mirror image.

The elevator door with the conventional clutch device as constructed above operates as follows.

At first when the elevator car 2 arrives at a destined floor, a door opening command is generated. The door motor 4 then starts to rotate clockwise according to the door opening command. Rotation of the door motor 4 is reduced through the first and second reduction pulley 5*a*, 5*b* and then moves the moving link 6. If the moving link 6 moves in linkage with the second reduction pulley 5*b*, one end of the main link 7 connected to the moving link 6 angularly moves clockwise. At this time, because the main link 7 is constructed to rotate on center of the rotating joint 7*a* at the mediate portion thereof, the other end of the main link 7 also rotates clockwise. When the other end of the main link 7 rotates clockwise, the cam link 13 of the left door panel 10*a* angularly moves counterclockwise, which makes the left door panel 10*a* opened left. On the other hand, clockwise rotation of the main link 7 is linked with the connecting link 8, one end of which is combined at an upper mediate portion of the main link 7, and then linked with the sub-link 9 combined with the other end of the connecting link 8. However, while the main link 7 rotates clockwise, the sub-link 9, one end of which is rotatably fixed to the car frame 31 with the rotating joint 9*a*, rotates counterclockwise. If the sub-link 9 rotates counterclockwise, the cam link 16 of the right door panel 10*b* angularly moves counterclockwise, which makes the right door panel 10*b* opened aright.

At this point, when each cam link 13, 16 angularly moves clockwise or counterclockwise, the roller 13*a*, 16*a* of each cam link 13, 16 moves along the curved portion of the rugged cam 12*a*, 15*a*. Due to variation of the depth of the curved portion, the movable clutch plates 12, 15 of the left and right door panels 10*a*, 10*b* angularly moves on center of the hinges 17*a*, 17*b* on the fixed clutch plates 11, 14. Due to rotation of the movable clutch plate 12, 15, the fixed and rotating clutch rollers 21, 23 and 22, 24 are closely contacted between the fixed and movable clutch plates 11, 14 and 12, 15, which is completion of the clutch operation.

After that, the left and right hatch door panel 20*a*, 20*b* are opened to opposite directions according to movement of the left and right car door panel 10*a*, 10*b*, which makes the elevator door open.

Such serial clutch operation is explained in detail with reference to FIG. 8 to FIG. 11. FIG. 8 to FIG. 11 show the clutch operation of the clutch device according to the conventional elevator door in sequence, all of which have vertical section view and side view.

At first, FIG. 8 shows clutch operation of the car door 10 and the hatch door 20 at the time that the elevator car 2 is moving or arrives at a destined floor. Referring to the figure, the clutch plates 11, 12 and 14, 15 of the car door 10 and the clutch rollers 21, 22 and 23, 24 of the hatch door 20 maintain clearance therebetween as much as G1 at this time. After that, when the car door 10 starts opening, the car door 10 moves while the hatch door 20 maintains its closed position until the fixed clutch plate 11, 14 of the car door 10 comes in contact with the rotating clutch roller 22, 24 of the hatch door 20.

Next, FIG. 9 shows the time that the clutch operation begins between the car door 10 and the hatch door 20. Referring to figure, moving distance of the car door 10 until the fixed clutch plate 11, 14 of the car door 10 comes in contact with the rotating clutch roller 22, 24 of the hatch door 20 corresponds to Sl. As the car door 10 opens as much as S1, angular displacement of the cam link 13, 16 is from A1 to A2. In addition, the angular displacement of the cam link 13, 16 causes the movable clutch plate 12, 15 to angularly move on center of the hinge 17*a*, 17*b*. At this time, the left and right hatch door panels 20*a*, 20*b* moves along with the left and right car door panels 10*a*, 10*b* and clearance between the movable clutch plate 12, 15 of the car door 10 and the fixed clutch roller 21, 23 of the hatch door 10 becomes G2. Furthermore, clutching state, at this time, is not perfect because of the clearance G2 between the movable clutch plate 12, 15 of the car door 10 and the fixed clutch roller 21, 23 of the hatch door 20, while the fixed clutch plate 11, 14 of the car door 10 is in contact with the rotating clutch roller 22, 24 of the hatch door 20.

Next, FIG. 10 shows the time that the hatch door 20 starts to move along with the car door 10. At this time, the car door 10 advances a little more than that of FIG. 9. Referring to the figure, angle of the cam link 13, 16 displaces from A2 to A3. In addition, the movable clutch plate 12, 15 begins to rotate on center of the hinge 17*a*, 17*b* due to the angular displacement of the cam link 13, 16. Clearance between the movable clutch plate 12, 15 of the car door 10 and the fixed clutch roller 21, 23 of the hatch door 20 becomes G3 due to angular movement of the movable clutch plate 12, 15, which is slightly narrower than G2 at the time that the car door 10 moves as much as S1. In FIG. 10, the car door 10 moves as much as S2, which is more advanced than S1.

Finally, FIG. 11 shows the time that the clutch operation between the car door 10 and the hatch door 20 is completed. As shown in the figure, if the car door 10 continues to move until as much as S3, the movable clutch plate 12, 15 of the car door 10 comes in contact with the fixed clutch roller 21, 23 of the hatch door 20 so to make clearance therebetween changed into 0 from S3. This is completion of the clutch operation between the car door 10 and the hatch door 20. From closed state to the completion of the clutch operation, the car door 10 moves as much as S3, which is called as "clutch completion distance".

When opening the door, the car door 10 and the hatch door 20 moves at a low speed until completion of the clutch operation, and at a high speed after the completion of the clutch operation.

Closing process of the elevator door is the reverse of the door opening process.

For the purpose of reducing time to open the conventional elevator door, there are methods of both or either increasing the clutch speed and/or reducing the clutch completion distance S3. However, in case of increasing the clutch speed, noises and vibration may be generated due to impact when the movable clutch plate 12, 15 of the car door 10 contacts with the fixed clutch roller 21, 23 of the hatch door 20. On the other hand, in case of reducing the clutch completion distance, the curved portion of the rugged cam 12*a*, 15*a* should having a steep inflection point in the light of angular displacement of the cam link 13, 16 required to contact the movable clutch plate 12, 15 of the car door 10 to the fixed clutch roller 21, 23 of the hatch door 20. However, such configuration requires stronger force for the roller 13*a*, 16*a* of the cam link 13, 16 to move along the steep slope of the rugged cam 12*a*, 15*a*, which may cause a problem of the door motor 4 to be overloaded.

SUMMARY OF THE INVENTION

Therefore, the present invention is designed to overcome the above problems of the prior art. An object of the invention is to provide an elevator door with an improved clutch device which may reduce time to open or close the elevator door without requiring overload to a door motor by decreasing the clutch completion distance.

In order to accomplish the object, the present invention provides an elevator door with a clutch device comprising: a hatch door provided at each floor in a building for passengers to board on/off an elevator car, the hatch door having a pair of clutch rollers installed thereto; a car door installed to the elevator car for passengers to board on/off the elevator car, the car door having a pair of clutch plates installed thereto, a pair of the clutch rollers passing through or interposed between a pair of the clutch plate; a door motor for giving force to move the car door; a reduction pulley for reducing rotating speed of the door motor; a plurality of links connected to the reduction pulley for converting rotation of the reduction pulley to angular movement; a cam link having one end rotatably connected to one of the links, the cam link including a curved portion having various curvatures formed at the other end thereof; and a rotating link positioned between a pair of the clutch plates, the rotating link being rotatably connected to one of the clutch plates and in contact with the other of the clutch plates, the rotating link contacting with the curved portion of the cam link at its mediate portion, wherein angular movement of the cam link pushes the rotating link along the curved portion, which brings a pair of the clutch plates into contact with a pair of the clutch rollers respectively.

The rotating link can be rotatably combined with one of a pair of the clutch plate at one end thereof, and the rotating link may comprise a first rotating roller mounted at a mediate portion thereof for contact with the curved portion of the cam link, and a second roller mounted at the other end thereof for contact with the other of a pair of the clutch plates.

The first rotating roller may be detachable from the rotating link in order to modulate distance from a rotating center of the rotating link thereto.

One of a pair of the clutch plates is preferably fixed to the car door, and the other clutch plate is movable.

The fixed clutch plate may have a guide bracket which is slidably inserted into the movable clutch plate, the guide bracket guiding moving direction of the movable clutch plate.

It is more preferred that an elastic member be installed between a pair of the clutch plates in order to provide tension force to the clutch plate such that the clutch plates recover initial positions when broadened.

BRIEF DESCRIPTION OF THE DRAWINGS

These and other features, aspects, and advantages of the present invention will become better understood with regard to the following description, appended claims, and accompanying drawings, in which like components are referred to by like reference numerals. In the drawings:

DETAILED DESCRIPTION OF THE PREFERRED EMBODIMENT

Hereinafter, preferred embodiments of the present invention will be described in detail with reference to the accompanying drawings.

Figure 1:
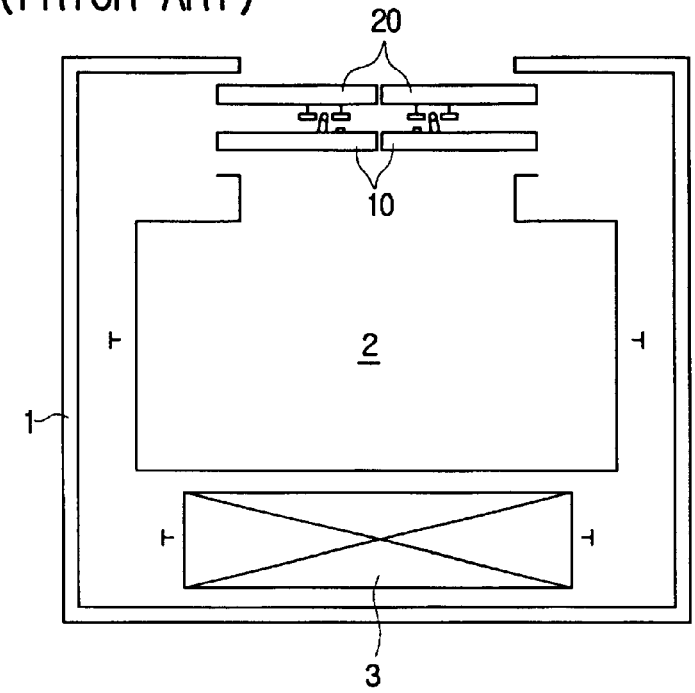
FIG. 1 (PRIOR ART)
FIG. 1 is a horizontal section view showing a conventional elevator schematically.
Figure 2:
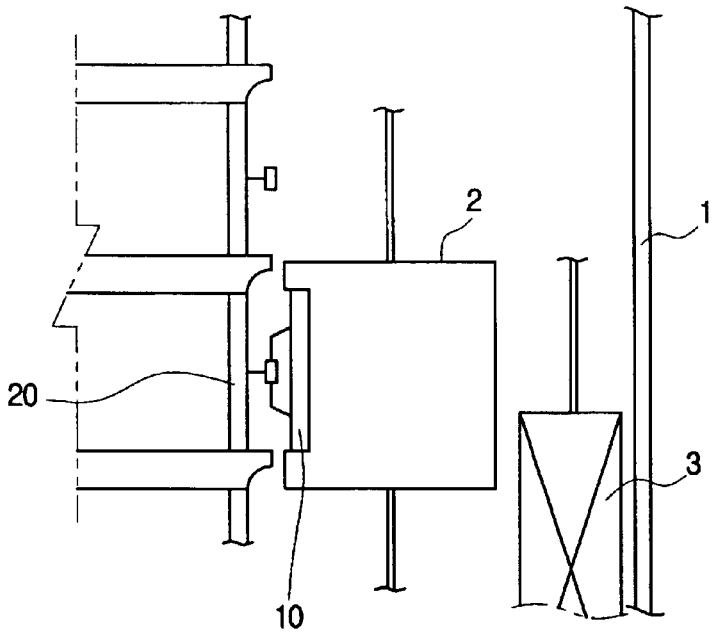
FIG. 2 (PRIOR ART)
FIG. 2 is a vertical section view showing the elevator of FIG. 1 schematically.
Figure 3:
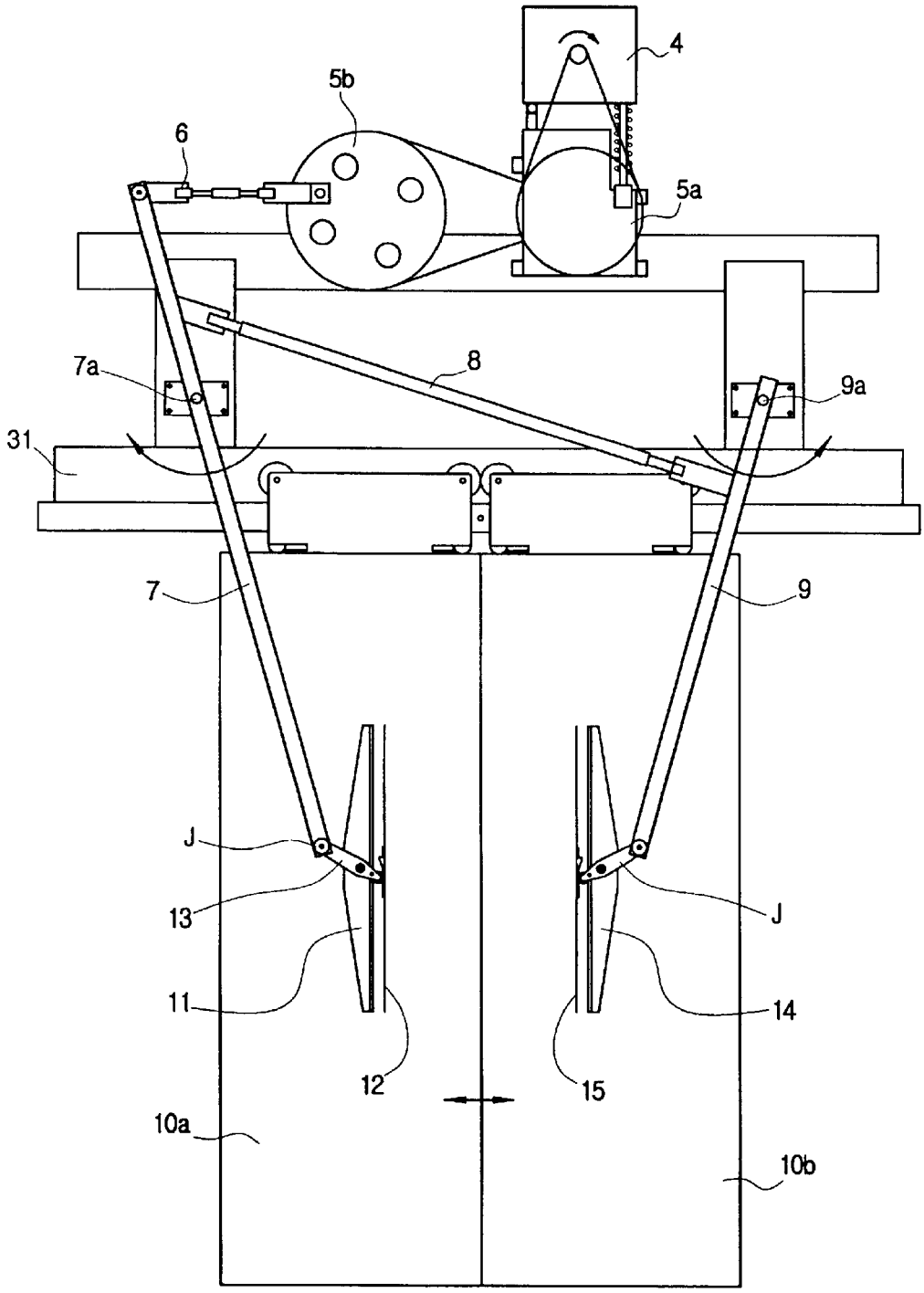
FIG. 3 (PRIOR ART)
FIG. 3 is a front view of a conventional elevator door viewed at a car door side.
Figure 4:
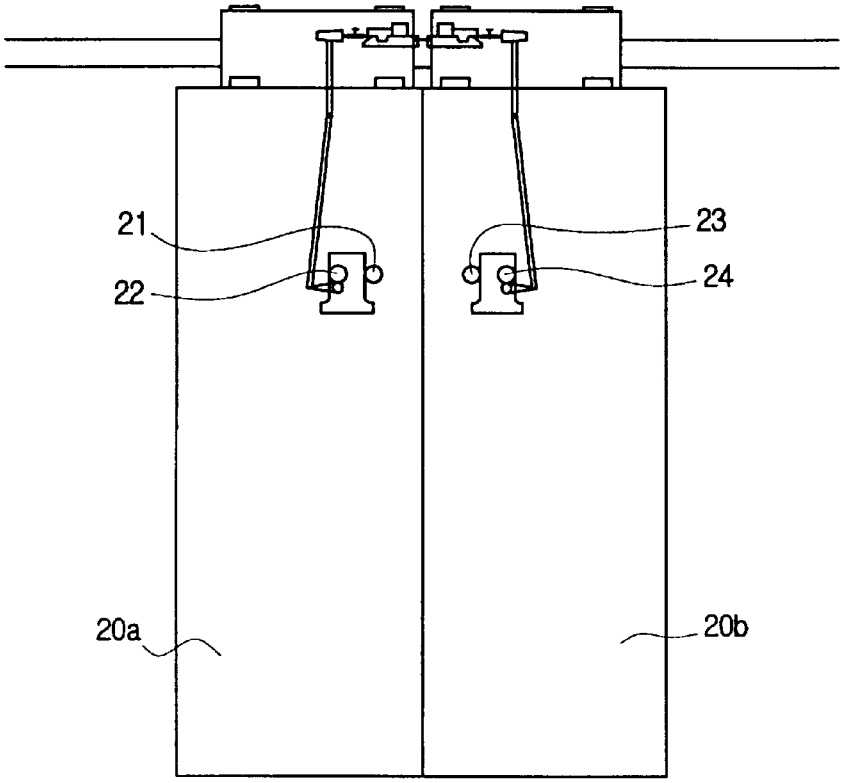
FIG. 4 (PRIOR ART)
FIG. 4 is a front view of the conventional elevator door viewed at a hatch door side.
Figure 5:
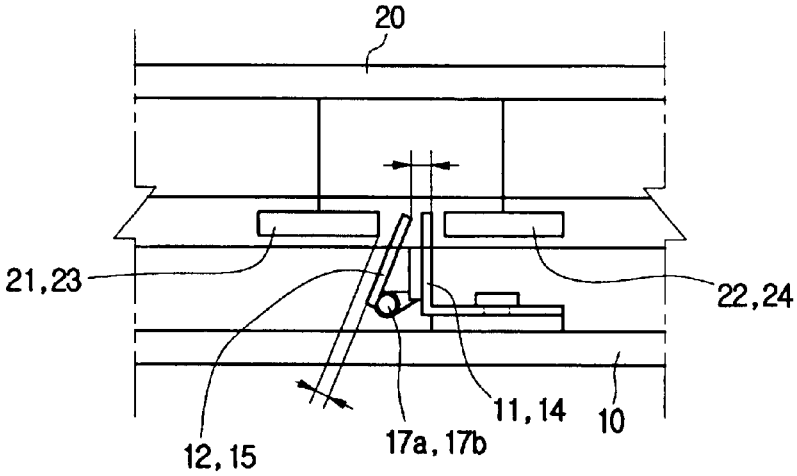
FIG. 5 (PRIOR ART)
FIG. 5 is a horizontal section view showing a clutch device of the conventional elevator door schematically.
Figure 6:
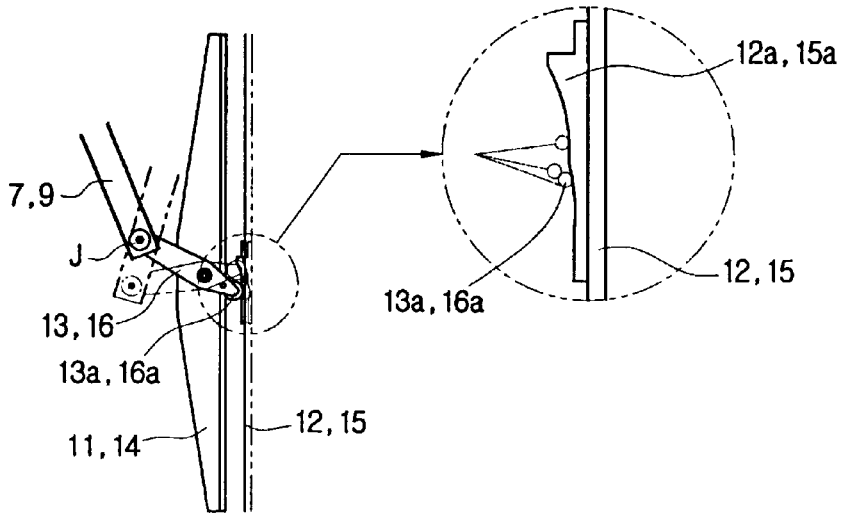
FIG. 6 (PRIOR ART)
FIG. 6 has a front view and a partially enlarged view for illustrating clutch operation of the clutch device of the conventional elevator door.
Figure 7:
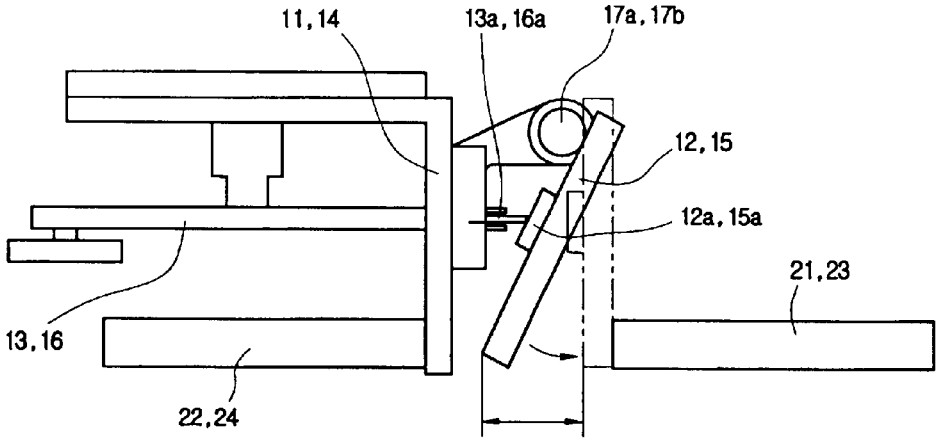
FIG. 7 (PRIOR ART)
FIG. 7 is a horizontal section view of FIG. 6.
Figure 8:
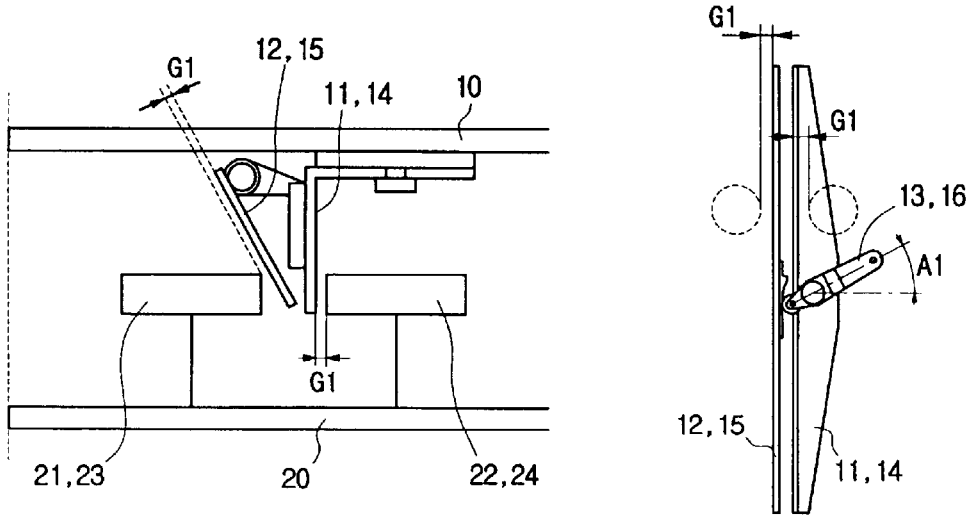
FIG. 8 (PRIOR ART)
FIG. 8 to FIG. 11 show the clutch operation of the clutch device of the conventional elevator door in sequence, each of which contains a horizontal section view and a side view.
Figure 9:
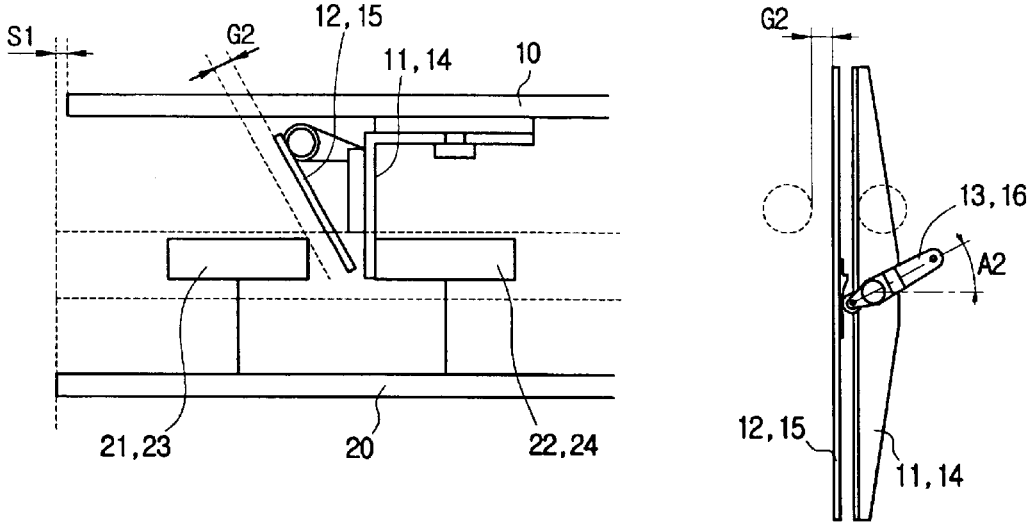
FIG. 9 (PRIOR ART)
Figure 10:
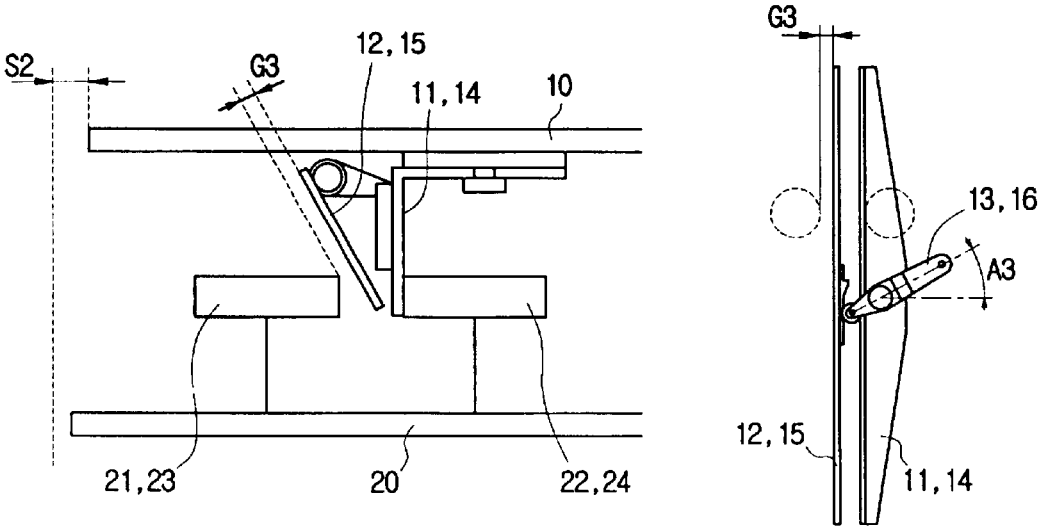
FIG. 10 (PRIOR ART)
Figure 11:
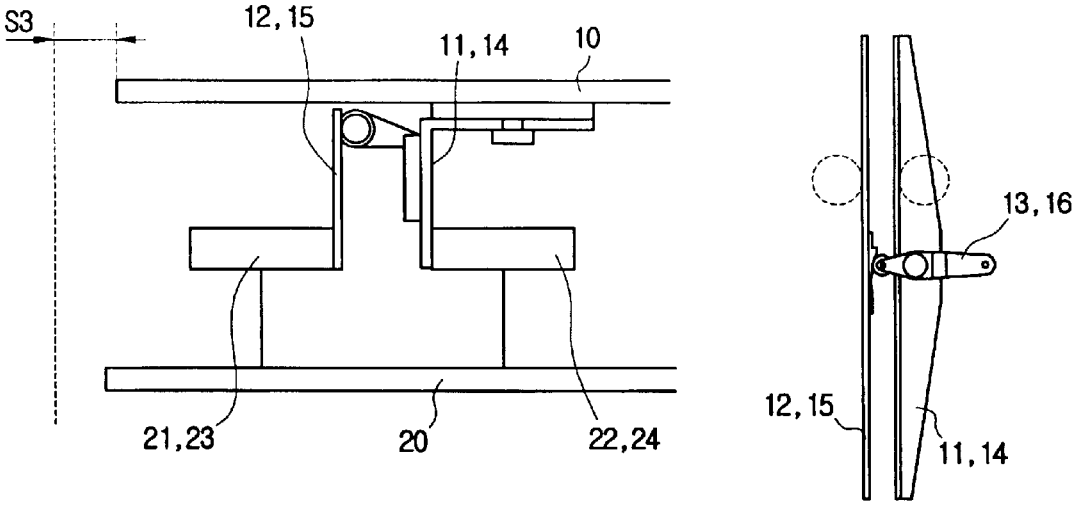
FIG. 11 (PRIOR ART)

General configurations of the elevator door of the present invention except a clutch device are similar to the prior art, and same parts as the prior art are indicated with same references in conjunction with FIG. 1 and FIG. 2 together.

The elevator door with the clutch device according to the present invention includes a car door 100 and a hatch door 200 (see FIG. 19 to FIG. 22). Like the prior art, the car door 100 is installed to the elevator car 2, which carries passengers with vertically moving by a separate driving unit in the hoist way 1 within a building. The hatch door 200 is installed at entrance of the elevator car 2 at each floor and opened and closed along with the car door 100.

Figure 12:
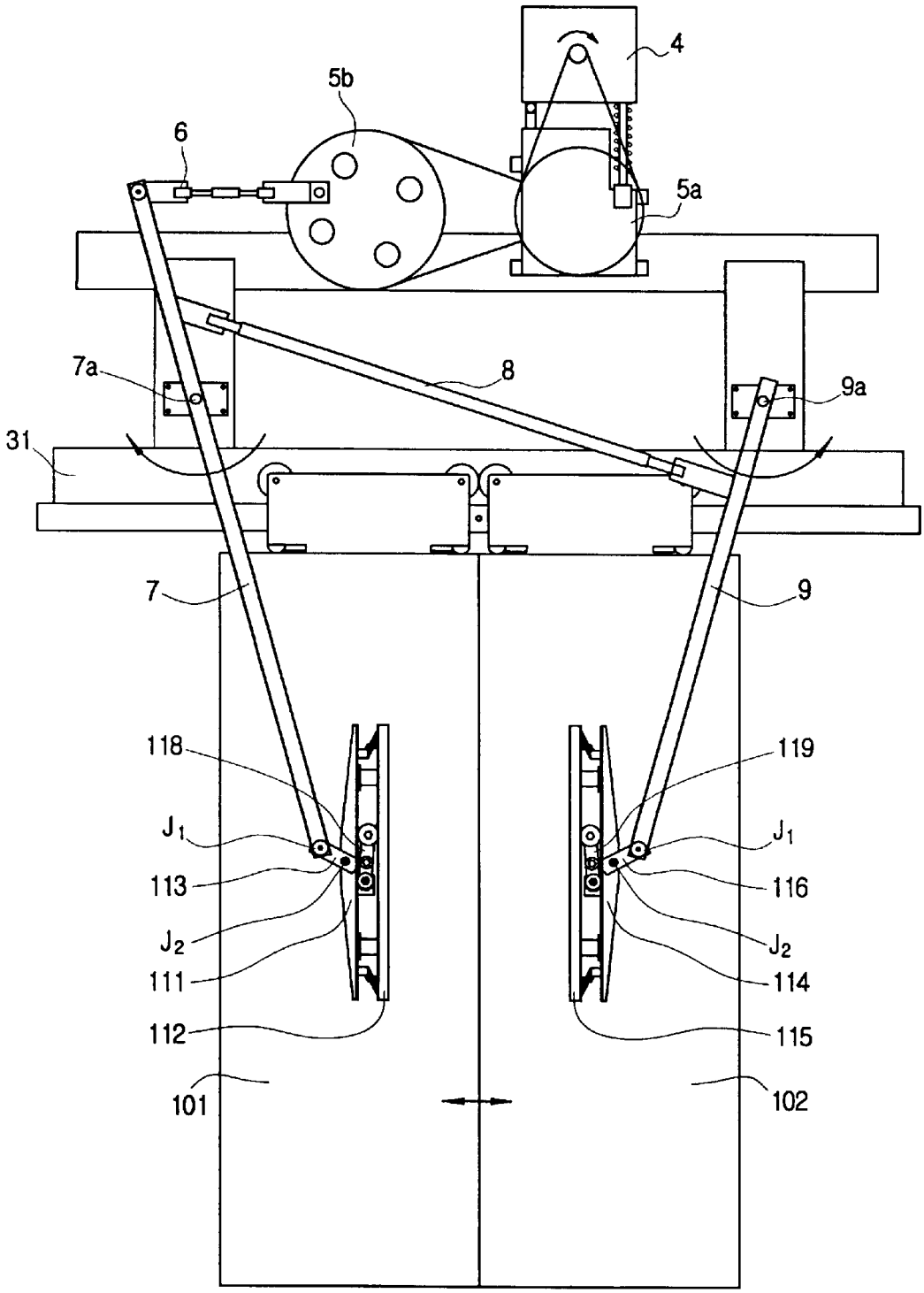
FIG. 12 is a front view for showing an elevator door according to the present invention, schematically.

FIG. 12 is a front view showing the elevator door according to the present invention schematically. Referring to the figure, a door motor 4 is mounted on the elevator car 2 for providing power to open or close the car door 100. At one side of the door motor 4, first and second reduction pulley 5*a*, 5*b* are sequentially installed to reduce rotating speed of the door motor 4. The second reducing pulley 5*b* is combined with one end of a moving link 6 such that the moving link 6 may move in linkage with rotation of the second reduction pulley 5*b*. The other end of the moving link 6 is rotatably combined with one end of a main link 7, which is also rotatably combined with the elevator car 2. The other end of the main link 7 is rotatably combined with a cam link 113, which is positioned at a left door panel 101. Viewed from the figure, a pair of clutch plates 111, 112 is installed at the left door panel 101, a fixed clutch plate 111 of which the cam link 113 is rotatably combined with. A car frame 31 is mounted upon the elevator car 2 for supporting the elevator car 2. The main link 7 is rotatably fixed to the car frame 31 with a rotating joint 7*a* at its mediate portion to possibly rotate on center of the rotating joint 7*a*. One end of a connecting link 8 is combined with an upper mediate portion of the main link 7. The other end of the connecting link 8 is rotatably connected to a certain position of a sub-link 9 at a right door panel 102. One end of the sub-link 9 is rotatably fixed to the car frame 31 with a rotating joint 9*a*, while the other end is also rotatably combined with one end of a cam link 116. Viewed from the figure, a pair of clutch plates 114, 115 is installed to the right door panel 102, a fixed clutch plate 114 of which the cam link 116 is rotatably combined with.

A pair of the clutch plates 111, 112 or 114, 115 at the left or right door panel 101 or 102 includes the fixed clutch plate 111 or 114 and a movable clutch plate 112 or 115. The fixed clutch plate 111 or 114 is fixed to each door panel 101, 102, and the cam link 113 or 116 is rotatably combined with the fixed clutch plate 111, 114 as described above. The movable clutch plate 112, 115 is combined with the fixed clutch plate 111, 114 by a hinge 117*a* or 117*b*, which is well shown in FIG. 14.

Figure 13:
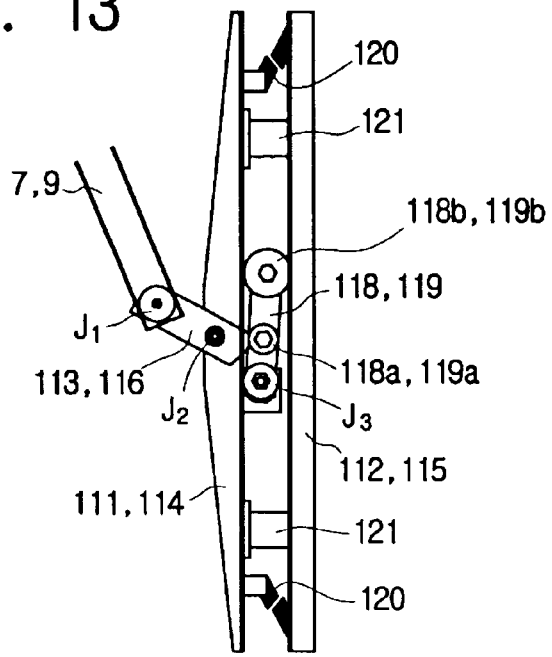
FIG. 13 is a front view showing a clutch device of the elevator door according to the present invention.

In addition, referring to FIG. 13, a guide bracket 121 is mounted to the fixed clutch plate 111, 114. One end of the guide bracket 121 is fixed to the fixed clutch plate 111, 114, while the other end is slidably inserted into the movable clutch plate 112, 115 in order to guide a moving direction of the movable clutch plate 112, 115.

Figure 14:
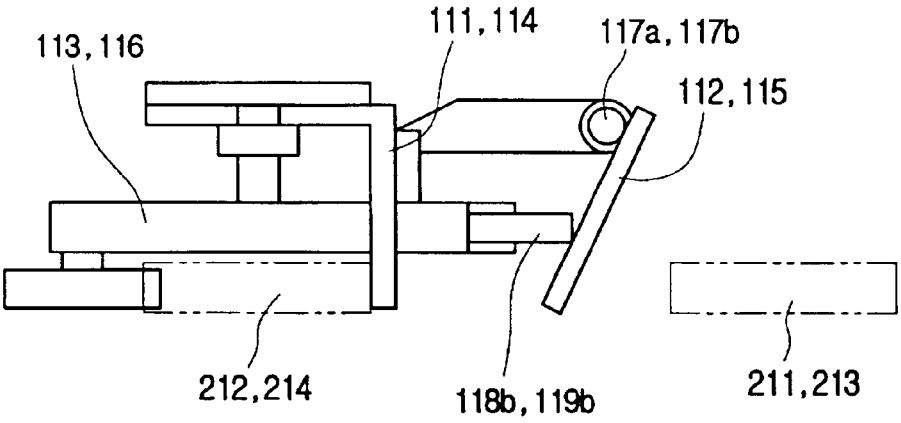
FIG. 14 is a horizontal section view of the clutch device of FIG. 13.

Referring to FIG. 13 and FIG. 14, a pair of clutch rollers 211, 212 or 213, 214 is mounted to each door panel (not shown) of the hatch door 200. The clutch rollers 211, 212 or 213, 214 include a fixed clutch roller 211, 213 and a rotating clutch roller 212, 214. A pair of the clutch plates 111, 112 or 114, 115 is configured to have certain clearance therebetween such that the clutch rollers 211, 212 or 213, 214 may pass through the clearance when the elevator is moving. However, when the elevator car 2 arrives at a destined floor, the clutch rollers 211, 212 or 213, 214 are interposed between and becomes contacted with a pair of the clutch plates 111, 112 or 114, 115 for the purpose of opening or closing the hatch door 200 along with the car door 100.

Figure 15:
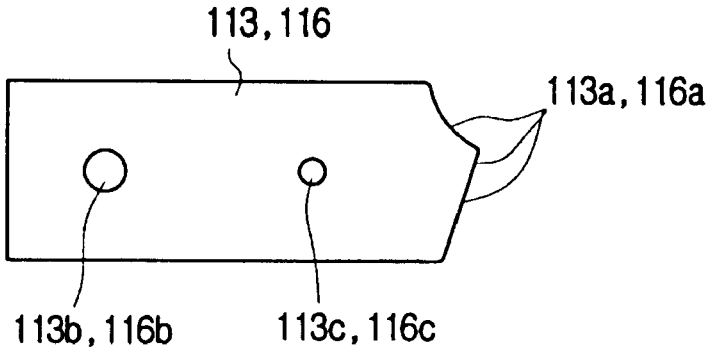
FIG. 15 is a front view for showing a cam link of the clutch device of the elevator door according to the present invention.

FIG. 15 shows the cam link 113, 116 of the clutch device according to the present invention. Referring to FIG. 15 in conjunction with the FIG. 13, the cam link 113, 116 is rotatably combined with the fixed clutch plate 111, 114 by a rotating joint J2. A curved portion 113*a*, 116*a* having various curvatures is formed at an end of the cam link 113, 116 to be in contact with a rotating link 118, 119 described below. When the cam link 113, 116 moves angularly, the cam link 113, 116 pushes the rotating link 118, 119 along the curved portion 113*a*, 116*a*, and then consequently pushes the movable clutch plate 112, 115 in contact with the rotating link 118, 119. The cam link 113, 116 has two joint inserting holes 113*b*, 113*c* or 116*b*, 116*c*, respectively. Through the joint inserting hole 113*b*, 116*b*, a rotating joint J1 is installed to rotatably combine the cam link 113, 116 with the main and sub links 7, 9, while the rotating joint J2 is installed through the joint inserting hole 113*c*, 116*c* in order to rotatably combine the cam link 113, 116 with the fixed clutch plate 111, 114.

Figure 16:
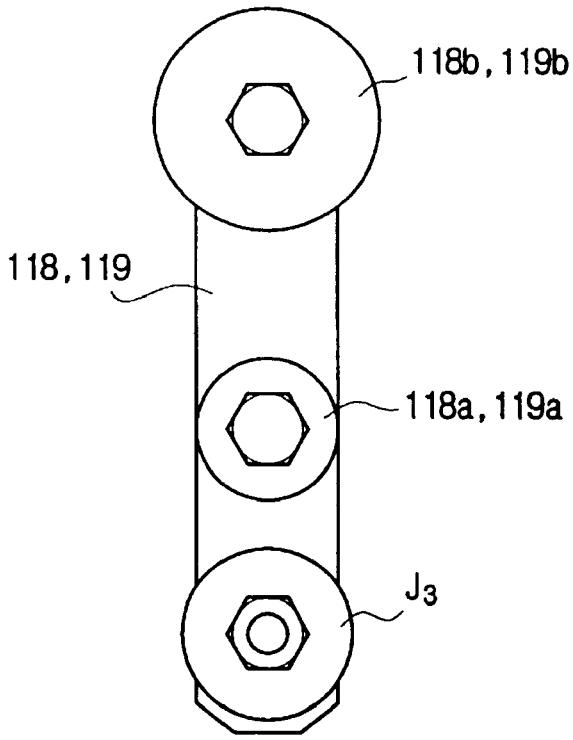
FIG. 16 is a front view for showing a rotating link of the clutch device of the elevator door according to the present invention.

FIG. 16 shows the rotating link 118, 119 of the clutch device according to the present invention. Referring to FIG. 16 in conjunction with FIG. 13, an end of the rotating link 118, 119 is rotatably combined with the fixed clutch plate 111, 114 by a rotating joint J3 such that the rotating link 118, 119 may rotate on center of the rotating joint J3. A first rotating roller 118*a*, 119*a* is mounted to a mediate portion of the rotating link 118, 119. The first rotating roller 118*a*, 119*a* is detachable so to possibly change its mounting position with the rotating link 118, 119. The first rotating roller 118*a*, 119*a* rolls in contact with the curved portion 113*a*, 116*a* of the cam link 113, 116. When the cam link 113, 116 moves angularly, the first rotating roller 118*a*, 119*a* is pushed by the curved portion 113*a*,116*a* such that the rotating link 118, 119 may rotate on center of the rotating joint J3. Changing the mounting position of the first rotating roller 118*a*, 119*a* makes a distance from the rotating joint J3, or center of rotating, to the first rotating roller 118*a*, 119*a* changed, which eventually changes angular displacement of the rotating link 118, 119. A second rotating roller 118*b*, 119*b* is mounted at an end of the rotating link 118, 119. The second rotating roller 118*b*, 119*b* is rotatable in contact with the movable clutch plate 112, 115.

In addition, a tension coil spring 120 is positioned between each of the fixed clutch plate 111, 114 and the movable clutch plate 112, 115, which is well shown in FIG. 13. The tension coil spring exerts tension force for the movable clutch plate 112, 115 to recover its origin position when the clearance between the fixed clutch plate 111, 114 and the movable clutch plate 112, 115 is broadened.

The elevator door with the clutch device as constructed above operates as follows.

At first when the elevator car 2 arrives at a destined floor, a door opening command is generated. The door motor 4 then starts to rotate clockwise according to the door opening command. Rotation of the door motor 4 is reduced through the first and second reduction pulley 5*a*, 5*b* and then moves the moving link 6. If the moving link 6 moves in linkage with the second reduction pulley 5*b*, one end of the main link 7 connected to the moving link 6 moves angularly clockwise. At this time, because the main link 7 is constructed to rotate on center of the rotating joint 7*a* at the mediate portion thereof, the other end of the main link 7 also rotates clockwise. When the other end of the main link 7 rotates clockwise, the cam link 113 of the left door panel 101 angularly moves counterclockwise, which makes the left door panel 101 opened left. On the other hand, clockwise rotation of the main link 7 is linked with the connecting link 8, one end of which is combined at an upper mediate portion of the main link 7, and then linked with the sub-link 9 combined with the other end of the connecting link 8. However, while the main link 7 rotates clockwise, the sub-link 9, one end of which is rotatably fixed to the car frame 31 with the rotating joint 9*a*, rotates counterclockwise. If the sub-link 9 rotates counterclockwise, the cam link 116 of the right door panel 102 angularly moves clockwise, which makes the right door panel 102 opened right.

Figure 17:
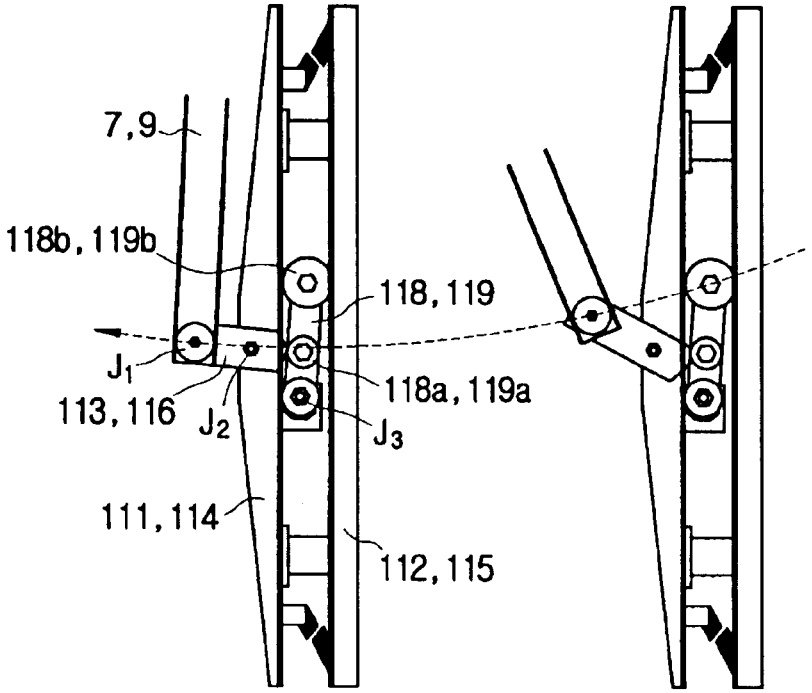
FIG. 17 is a diagram for illustrating clutch operation of the clutch device of the elevator door according to the present invention.
Figure 18:
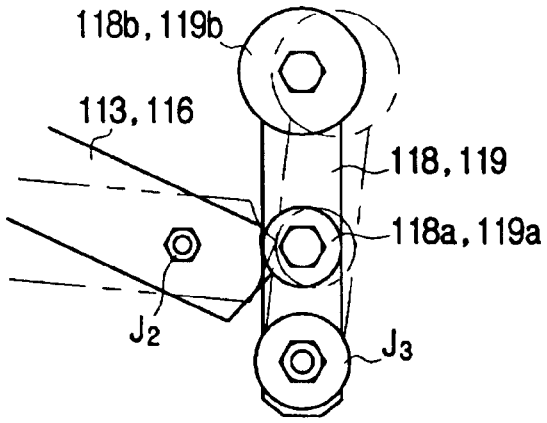
FIG. 18 shows essential parts for illustrating the clutch operation of the clutch device of the elevator door according to the present invention; and FIG. 19 to FIG. 22 shows the clutch operation of the clutch device of the elevator door according to the present invention, each of which contains a horizontal section view and a side view.

While the prior art employs the rugged cam formed on the movable clutch plate, the present invention uses the curved portion 113*a*, 116*a* formed at an end of the cam link 113, 116 and the rotating link 118, 119 in contact with the curved portion 113*a*, 116*a*. The process that the curved portion 113*a*, 116*a* of the cam link 113, 116 is linked with the rotating link 118, 119 is well shown in FIG. 17 and FIG. 18. Referring to the figures, as the cam link 113, 116 moves angularly, the curved portion 113*a*, 116*a* formed at the end of the cam link 113, 116 rotates in contact with the first rotating roller 118*a*, 119*a* of the rotating link 118, 119. Rotation of the curved portion 113*a*, 116*a* pushes the rotating link 118, 119 according to the curvature of the curved portion 113*a*, 116*a*, which eventually pushes the movable clutch plate 112, 115 to move laterally.

FIG. 19 to FIG. 22 show the clutching operation of the clutch device according to the present invention in sequence. The clutching operation of the present invention is explained in more detail with reference to the figures.

Figure 19:
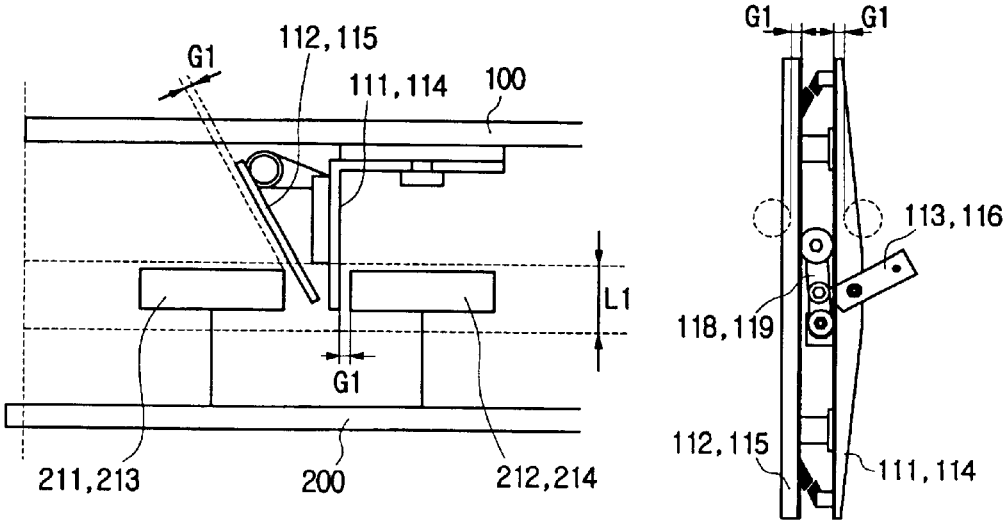

At first, FIG. 19 shows clutching operation of the car door 100 and the hatch door 200 at the time that the elevator car is moving or arrives at a destined floor. Referring to the figure, the clutch plates 111, 112 or 114, 115 of the car door 100 and the clutch rollers 211, 212 or 213, 214 of the hatch door 200 maintain clearance therebetween as much as G1 at this time in order that the clutch plates 111, 112 or 114, 115 of the car door 100 and the clutch rollers 211, 212 or 213, 214 of the hatch door 200 should not impact each other.

Figure 20:
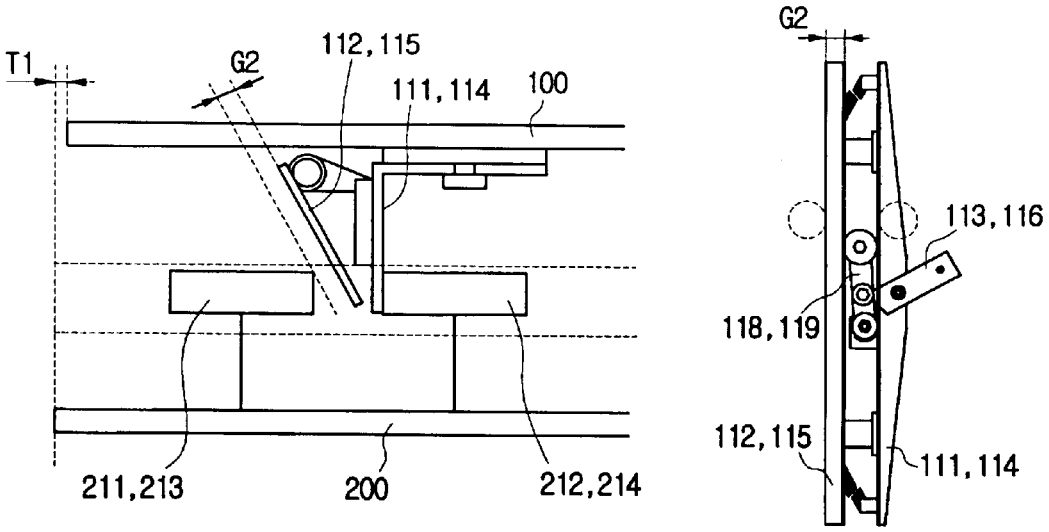

FIG. 20 shows the clutching operation at the time that the car door 100 starts to move after the elevator car 2 arrives at the destined floor. At this time, the hatch door 200 is not moving yet. At this time, the cam link 113, 116 begins to rotate clockwise by the door motor 4, the reduction pulleys 5*a*, 5*b*, the moving link 6 and the main link 7. Referring to the figure, the curved portion 113*a*, 116*a* formed at the end of the cam link 113, 116 moves angularly in contact with the first rotating roller 118*a*, 119*a* mounted at a mediate portion of the rotating link 118, 119. When the cam link 113, 116 moves angularly, a distance from a rotating center J2 of the cam link 113, 116 to a contact point of the curved portion 113*a*, 116*a* with the first rotating roller 118*a*, 119*a* of the rotating link 118, 119 becomes slightly longer. Therefore, the rotating link 118, 119 becomes rotating with being pushed on center of the hinge 117*a*, 117*b* of the fixed clutch plate 111, 114, which eventually pushes the movable clutch plate 112, 115 slightly. At this time, the fixed clutch plate 111, 114 comes in contact with the rotating clutch roller 212, 214 and moves the car door 100 as much as T1. Therefore, clearance between the movable clutch plate 112, 115 and the fixed clutch roller 211, 213 is broadened from G1 to G2.

Figure 21:
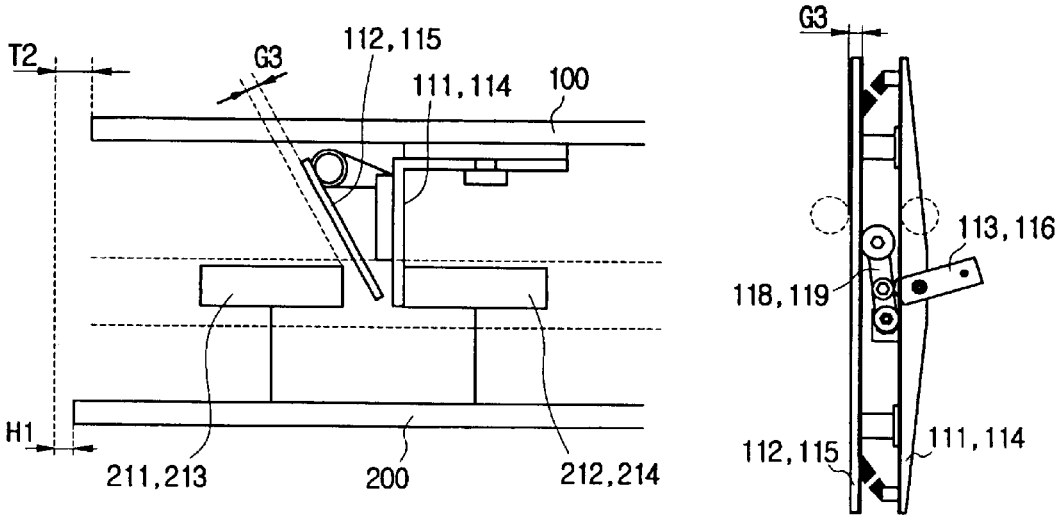

FIG. 21 shows the clutching operation at the time that the hatch door 200 begins to move along with the car door 100. At this time, the car door 100 moves as much as T2, and the hatch door 200 moves as much as H1 with being led by the car door 100. Referring to the figure, as the cam link 113, 116 rotates a little more, the curved portion 113*a*, 116*a* of the cam link 113, 116 pushes the rotating link 118, 119 a little further. At this time, the fixed clutch plate 111, 114 is continuously in contact with the rotating clutch roller 212, 214 and the clearance between the movable clutch plate 112, 115 and the fixed clutch roller 211, 213 becomes narrow from G2 to G3.

Figure 22:
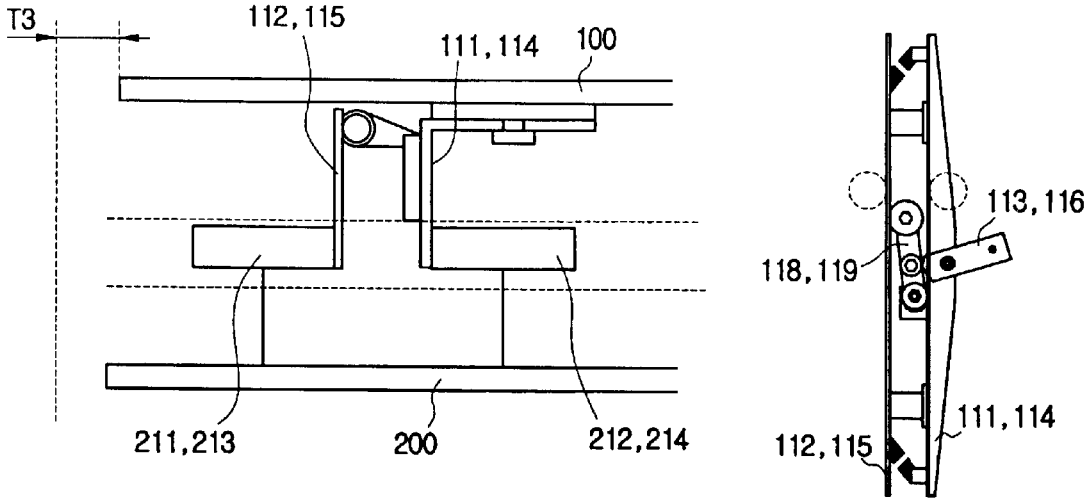

FIG. 22 shows the time that the clutching operation of the car door 100 and the hatch door 200 is completed. Referring to the figure, the car door 100 moves as much as T3 and the hatch door 200 moves as much as H2 with being led by the car door 100. At this time, the cam link 113, 116 rotates more so that the curved portion 113*a*, 116*a* pushes the rotating link 118, 119 further. Therefore, the fixed clutch plate 111, 114 and the movable clutch plate 112, 115 come in contact with the rotating clutch roller 212, 214 and the fixed clutch roller 211, 213, respectively.

In the described clutch device, the clutch speed can be adjusted by changing the curvature of the curved portion 113*a*, 116*a* of the cam link 113, 116. In addition, the clutch speed can be also adjusted by modulating the contact point between the curved portion 113*a*, 116*a* and the first rotating roller 118*a*, 119*a*.

Among the methods for adjusting the clutch speed, the method of modulating the contact point between the curved portion 113*a*, 116*a* and the first rotating roller 118*a*, 119*a* is described in detail. For the sake of the method, what is needed is to modulate distance from the rotating center J3 of the rotating link 118, 119 to the detachable first rotating roller 118*a*, 119*a*. If the first rotating roller 118*a*, 119*a* is positioned nearer to the rotating center J3 of the rotating link 118, 119, angular displacement of the rotating link 118, 119 for same angular movement of the cam link 113, 116 becomes increased. In other word, though the first rotating roller 118*a*, 119*a* moves same distance, the second rotating roller 118*b*, 119*b* moves further than the case before the modulation. Therefore, to increase the angular displacement of the rotating link 118, 119 in such manner has same effect as to increase the curvature of the curved portion 113*a*, 116*a* of the cam link 113, 116.

Therefore, in order to increase the clutch speed, what is to do is to increase the curvature of the curved portion 113*a*, 116*a* of the cam link 113, 116 and/or relocate the first rotating roller 118*a*, 119*a* near the rotating center J3 of the rotating link 118, 119. In such manner, the clutch distance of the car door 100 and the hatch door 200 is reduced, which makes the low-speed travel region decreased and eventually makes it possible to reduce time to open or close the elevator door.

As described above, the elevator door with the improved clutch device has advantages in carrying passengers in light that the clutch completion distance of the car door and the hatch door may be reduced without requiring overload to the door motor.

The elevator door with the improved clutch device according to the present invention has been described in detail. However, it should be understood that the detailed description and specific examples, while indicating preferred embodiments of the invention, are given by way of illustration only, since various changes and modifications within the spirit and scope of the invention will become apparent to those skilled in the art from this detailed description.

What is claimed is:

1. An elevator door with a clutch device comprising:

a hatch door provided at each floor in a building for passengers to board on/off an elevator car, the hatch door having a pair of clutch rollers installed thereto;

a car door installed to the elevator car for passengers to board on/off the elevator car, the car door having a pair of clutch plates installed thereto, the pair of the clutch plates passing through or interposed between the pair of the clutch rollers;

a door motor for giving force to move the car door;

a reduction pulley for reducing rotating speed of the door motor;

a plurality of links connected to the reduction pulley for converting rotation of the reduction pulley to angular movement;

a cam link having one end rotatably connected to one of the links, the cam link including a curved portion having various curvatures formed at the other end thereof; and a rotating link positioned between the pair of the clutch plates, the rotating link being rotatably connected to one of the clutch plates and in contact with the other of the clutch plates, the rotating link contacting with the curved portion of the cam link at its mediate portion, wherein angular movement of the cam link pushes the rotating link along the curved portion, which brings the pair of the clutch plates into contact with the pair of the clutch rollers respectively.

2. An elevator door with a clutch device as claimed in claim 1, wherein the rotating link is rotatably combined with one of the clutch plates at one end thereof, and wherein the rotating link comprises a first rotating roller mounted at a mediate portion thereof for contact with the curved portion of the cam link, and a second roller mounted at the other end thereof for contact with the other clutch plates.

3. An elevator door with a clutch device as claimed in claim 2, wherein the first rotating roller is detachable from the rotating link in order to modulate distance from a rotating center of the rotating link thereto.

4. An elevator door with a clutch device as claimed in claim 1, wherein one of the clutch plates is fixed to the car door, and the other clutch plate is movable.

5. An elevator door with a clutch device as claimed in claim 4, wherein the fixed clutch plate has a guide bracket which is slidably inserted into the movable clutch plate, the guide bracket guiding moving direction of the movable clutch plate.

6. An elevator door with a clutch device as claimed in claim 1, wherein an elastic member is installed between the pair of the clutch plates in order to provide tension force to the clutch plates such that the clutch plates recover initial positions when broadened.

* * * * *